United States Patent [19]

Ollendick

[11] 4,157,178

[45] Jun. 5, 1979

[54] METHOD AND APPARATUS FOR REMOVING PAPER FROM A ROTATING DRUM

[75] Inventor: Gary B. Ollendick, Chicago, Ill.

[73] Assignee: Teletype Corporation, Skokie, Ill.

[21] Appl. No.: 662,780

[22] Filed: Mar. 1, 1976

[51] Int. Cl.[2] ..... B65H 5/12

[52] U.S. Cl. ..... 271/276; 271/3; 271/196; 346/138

[58] Field of Search ..... 271/276, 196, 194, 3, 271/174, DIG. 2, 80; 346/138; 101/232

[56] References Cited

U.S. PATENT DOCUMENTS

| | | | |
|---|---|---|---|
| 3,258,530 | 6/1966 | Fowlie et al. | 271/196 X |
| 3,545,746 | 12/1970 | Ledger et al. | 271/196 |
| 3,609,724 | 9/1971 | Allison et al. | 271/196 X |

*Primary Examiner*—Bruce H. Stoner, Jr.

*Attorney, Agent, or Firm*—W. K. Serp; J. C. Albrecht

[57] ABSTRACT

A paper web is maintained on a rotating apertured drum by means of a vacuum created inside of the drum. The paper length is slightly greater than the circumference of the drum thereby providing a tangentially projecting flap which is detected by a flap sensor. The concurrance of a pulse from the flap sensor with an end of message signal enables a counter. A first series of selected states of the counter are decoded and used to interrupt the vacuum causing the paper to come to rest against a shroud surrounding the drum. A second series of counter states, some of which coincide with the first series, open a discharge door covering a paper discharge opening in the shroud. When the vacuum is reapplied to the drum, upon expiration of the first series of counter states, the rotating drum boosts the paper out through the discharge opening.

6 Claims, 2 Drawing Figures

METHOD AND APPARATUS FOR REMOVING PAPER FROM A ROTATING DRUM

FIELD OF THE INVENTION

This invention relates to a method and apparatus for removing a sheet of paper from a rotating drum whereon it is maintained by vacuum pressure and more particularly relates to a control circuit for removing paper from the drum of a graphic printer.

BACKGROUND OF THE INVENTION

Various graphic printers have been described wherein a sheet of paper is positioned on a rotating drum and maintained thereon by means of a vacuum created within the drum. A controlled ink stream is directed at the paper printing the desired pattern thereon. U.S. Patent Application Ser. No. 606,954, filed Aug. 27, 1975, by Hauser et al. and entitled "Paper Handling in Graphic Printer" and having a common assignee with this application and now abandoned describes such an arrangement. As shown in this application, the paper is carried on an apertured drum which is rotated past a print head. The print head moves slowly along the axis of the drum so as to raster scan from top to bottom and from left to right over the surface of the paper. To facilitate insertion and removal of the paper, a shroud is placed very close to the cylindrical surface of the drum and during paper insertion, guides the paper into close proximity with the drum.

A solenoid operated discharge door is provided in the shroud, at a convenient location, and serves to allow the paper to discharge from the drum after release of the vacuum. In response to energization of a solenoid, the door opens and the vacuum within the drum is released. As the paper springs away from the platen due to its natural curl and the centrifugal force exerted thereon, the leading edge of the paper exits from the space between the drum and the shroud, and through the discharge door. It will be appreciated that the speed of release and path of the paper from the drum, after the vacuum has been removed, is related to the weight and stiffness of the paper. Papers of a relatively heavy weight will be released much more quickly than those of a light weight. Such a condition makes it difficult to time the release of the vacuum so that the paper exits directly through the door rather than strikes the edge of the door opening or is forced to travel around the shroud before release. Should the paper be required to travel around the shroud, the centrifugal and frictional force may be insufficient to properly discharge various weight papers. Certain prior arrangements have experienced difficulty in adapting to varying weights of paper. Further, relative humidity effects the stiffness of the paper and may vary the frictional force required to assure that the paper will be discharged from the drum after release of the vacuum. To overcome such conditions for a given weight paper, the vacuum is released when the paper reaches a selected rotational position. The size of the drum is selected so that its circumference is slightly less than the length of the paper so as to provide overlap of the top and bottom edges of the paper.

A light beam is directed tangential to the platen and is interrupted by the paper flap. This light path interruption is sensed by a photocell and the output signal from the photocell is used to control the release of the vacuum in the platen at a selected position of the paper with respect to the exit door. Such a flap sensor is described in U.S. Patent Application Ser. No. 606,959 filed Aug. 22, 1975 by Sokolowski, now abandoned, and entitled "Paper Overlap Edge Sensor" and having a common assignee with this application. Application Ser. No. 606,959 has been replaced by a continuation application Ser. No. 773,246, filed Mar. 1, 1977, now U.S. Pat. No. 4,101,018. Although such an arrangement provides a workable solution for a relatively narrow range of paper weights and relative humidities, the aforementioned problems still exist. Should the user vary the weight of the paper from the weight for which the apparatus has been designed, malfunctioning frequently occurs.

The illustrated embodiment, hereinafter described, readily adapts to a wide range of paper weights without requiring individual paper weight adjustment and thus allows the operator to intermix paper weights as desired. As hereinafter described, paper discharge is accomplished by first releasing the vacuum in the drum to allow the paper to come to rest in the shroud and then reapplying the vacuum to boost the paper out of the discharge opening. Further, since the centrifugal force on the paper, as it is released from the drum, is not relied upon to force the paper out of the shroud, the weight and stiffness of the paper are minor considerations in determining the discharge effectiveness of the device.

SUMMARY OF THE INVENTION

An apparatus is described for discharging a sheet of paper from a rotating drum platen whereon it is maintained by vacuum pressure. A guide shroud is positioned about the drum and defines a paper discharge opening. Means are described for interrupting the vacuum within the drum and thereby allowing the paper to come to rest. Thereafter, the vacuum is reapplied so as to boost the paper from the shroud through the discharge opening.

Additionally, a shaft encoder is coupled to the drum and generates a pulse train driving a counter. A selected state of the counter is utilized to actuate the vacuum interrupting means. Additionally, a selectively operable door covers the discharge opening. The door is open during the reapplication of the vacuum allowing the paper to pass out of the shroud.

A method is described for removing a sheet of paper maintained by vacuum pressure on a rotating drum. The drum is substantially surrounded by a shroud defining a discharge opening. The step of releasing the vacuum within the drum to allow the paper to come to rest within the shroud is set forth as well as the step of reapplying the vacuum to boost the paper out of the shroud through the discharge opening.

It is a main object of this invention to provide a method and apparatus for controlling a web handling apparatus during the web discharge portion of its operating cycle. It is a further object to provide an apparatus which will handle various weights of paper while maintaining reliability during the paper discharge mode of operation. Other objects and advantages of the invention will be more readily appreciated after reference to the following description and accompanying drawings wherein:

DESCRIPTION OF THE ILLUSTRATED EMBODIMENT

General

Figure 1:
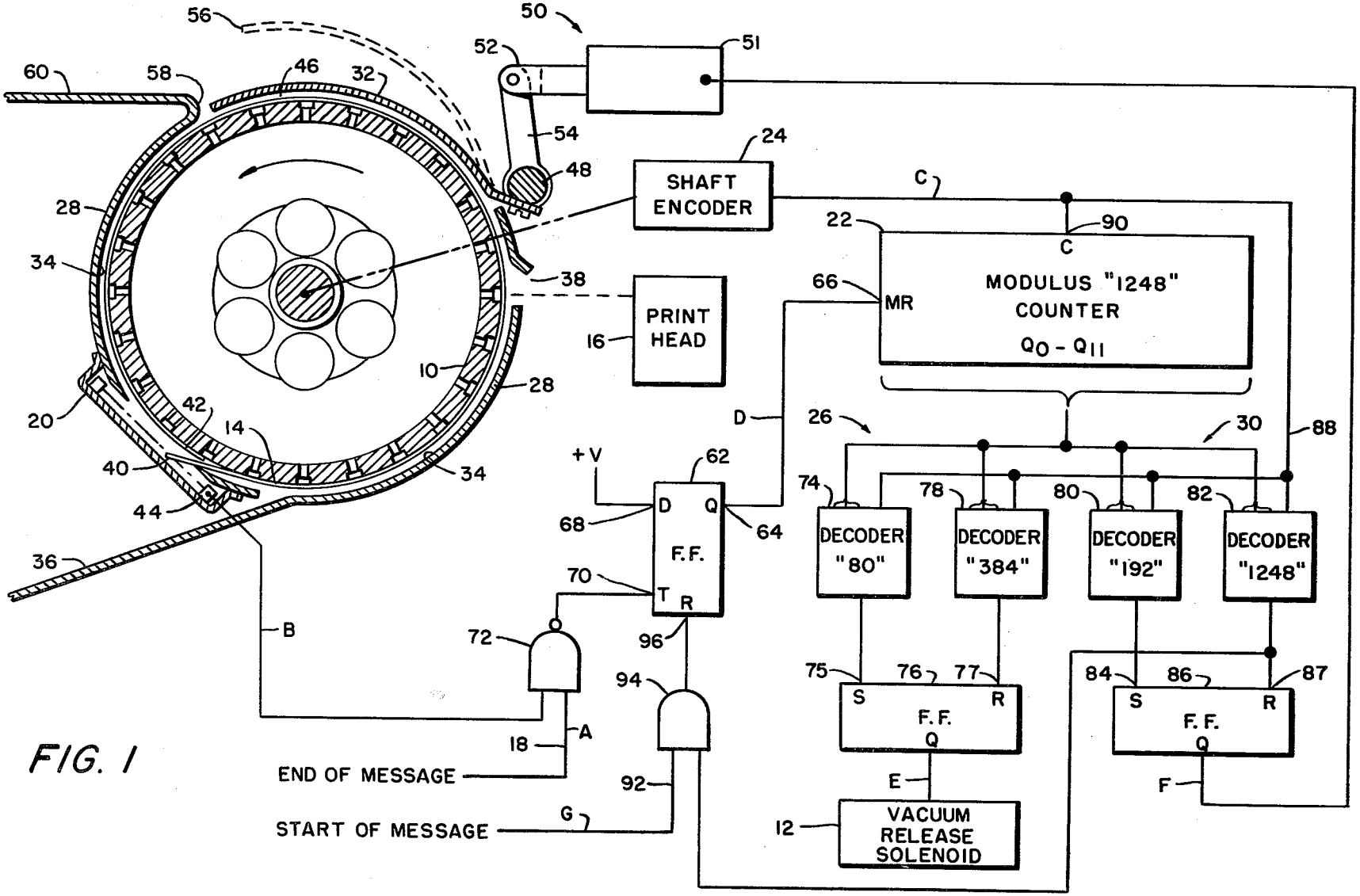
FIG. 1 is a paper discharge control circuit in combination with a drum and shroud assembly illustrating certain features of this invention.

With reference to FIG. 1 an apertured drum 10 is rotatably driven (by means not shown) and a vacuum is maintained therein controlled by a vacuum solenoid 12. A sheet of paper 14 is wrapped about the drum 10 and rotated therewith. Directing a stream of ink at the paper 14 so as to generate the desired pattern thereon is a print head 16. In response to an end of message signal A via line 18 and a paper flap position signal B generated by a paper flap sensor 20, a modulus "1248" counter 22 is enabled. The counter 22 is advanced by a pulse train C generated by a shaft encoder 24 coupled to the drum 10. The output of the counter is decoded by a first decoding means 26 which, during a first series of sequential counter 22 states, releases the vacuum within the drum 10 thereby allowing the paper 14 to be released from the drum 10 and come to rest along the inner surface of a shroud 28 surrounding the drum 10. Decoding a second series of sequential counter states is a second decoding means 30 which controls the position of a discharge door 32 in the shroud 28. After the door has been opened, the vacuum is again reapplied and the vacuum pressure within the spinning drum 10 reacting upon the paper 14 forces the paper out of the shroud 28. Thus, the illustrated circuitry serves to control the vacuum within the drum 10 and the position of the discharge door 32 during the paper discharge process. Initially, the vacuum is interrupted allowing the paper 14 to come to rest along an inner wall 34 of the shroud 28 and the discharge door 32 is opened. After the door 32 is opened, the vacuum is reapplied and the paper 14 boosted out of the shroud 28.

Detailed

As mentioned, the interior of rotating apertured drum 10 is evacuated. A suitable arrangement for producing the vacuum within the drum 10 is described in U.S. Patent Application Ser. No. 606,954, filed Aug. 22, 1975 by A. J. Hauser et al. entitled "Paper Handling and Graphic Printer" having a common assignee with this application and now abandoned. Positioned about the drum 10 and serving to guide the paper 14 during insertion and removal is a shroud 28. A portion of the shroud 28 is extended outwardly, defining a paper insertion guide 36. Additionally, a portion of the shroud 28 is opened slightly as at 38 to allow an ink jet generated by the print head 16 to strike the paper 14. The length of the paper 14 is slightly greater than the circumference of the drum 10 thereby defining an overlapping flap 40 which is blocked from the force of the vacuum by the opposite edge 42 of the paper 14. Serving to sense the presence of the flap 14, is the paper overlap flap sensor 20 which generates the signal B representing the relative position of the paper 14 within the shroud 28. A sensor suited for use in the illustrated embodiment is described in U.S. Patent Application Ser. No. 606,959, filed Aug. 22, 1975, by E. K. Sokolowski, and entitled "Paper Overlap Edge Sensor" and also having a common assignee with this application. Since the vacuum within the drum 10 does not attract the flap 40, the flap 40 follows the natural contour of the paper 14 and projects tangentially from the drum 10. Thus, as the paper 14 is rotated with the drum 10, it will break a light beam generated by the sensor interrupting the light path to a photocell 44 therein. The photocell, in turn, provides the flap output signal B.

Serving to pass the discharged paper 14 from the drum 10 is an opening 46 covered by the discharge door 32. The door 32 is pivotably supported adjacent the drum 10 by means of a support rod 48. The door 32 is swung about the rod 48 by means of a solenoid 50 including a coil 51 and plunger 52. The plunger 52 is connected via a crank 54 to the door 32. Thus when the solenoid 50 is energized, the plunger 52 is drawn into the coil 51 and the door 32 opens to the phantom position 56, allowing the paper 14 to exit through the discharge opening as will be subsequently further considered. A portion of the shroud 28, defining the discharge opening, is bent to form a bight 58 providing a smooth edge which serves to cam the paper 14 out along a paper discharge guide 60.

Controlling the operation of the counter 22 is a type "D" flip-flop 62. The direct output 64 signal of the flip-flop 62 is connected to a master reset input 66 of the counter 22 with a direct input 68 of the flip-flop being held high. A toggle input 70 to the flip-flop 62 is triggered on the positive edge of the output signal B from the flap sensor 20 coupled through a dual input NAND-gate 72. The remaining input of the gate 72 receives the end of message signal A via the line 18. The previously mentioned end of message signal A is provided by the transmitter, either via a direct connection or by means of a conventional decoder which responds to a unique end of message work of the incoming data stream. Thus, in response to the simultaneous presence of a flap sensor 20 output B as well as an end of message signal, the high level signal at the direct input 68 of the flip-flop 62 is transferred to the master reset input 66 of the counter 22 allowing the counter to advance.

Selected outputs of the modulus "1248" counter are fed to vacuum release and door opening decoders 26 and 30. The decoder 26 serves to decode the 80th count of the counter by means of a count "80" decoder 74 and the output of which is fed to the set input 75 of a control RS flip-flop 76. A remaining reset input 77 of the flip-flop 76 is driven by a count "384" decoder 78 which is similarly addressed by the output of the counter 22. Thus, it will be appreciated that the output E of the RS flip-flop 76 which drives the vacuum release solenoid 12 interrupts the vacuum within the drum 10 during counter states "80" through "384".

Similarly, count "192" is decoded by a 192 decoder and count "1248" is decoded by decoder 82. The output of the "192" decoder 80 is fed to a set input 84 of a discharge door control RS flip-flop 86 and the output of the "1248" decoder 82 is fed to a reset input 87 of the flip-flop 86. The direct output F of the flip-flop 86 serves to control the door solenoid 50, opening the door 32 during counter 22 states "192" through "1248". Thus, the discharge door 32 will be opening during a portion of the vacuum release time period as well as during the time period immediately following. The decoders 74, 78, 80, and 82 may be of any conventional form, well-known in the art. A suitable decoder may take the form of a multiple input NAND-gate, the inputs of which are connected to selected counter 22 output levels. As illustrated, the decoders 74, 78, 80, and 82 are synchronously operated with the counter 22 by means of the clocking signal C via a line 88 fed to one of their inputs. The clocking signal C is additionally fed into the clock input 90 of the counter 22. In this way, a signal coincidence is required between the output of the shaft decoder 24 and the decoded state of the counter 22 to alter the state of the corresponding flip-flops 76 and 86. As previously mentioned, the encoder signal C is generated by the shaft encoder 24 which provides a pulse train related to the speed of rotation of the drum. A suitable pulse generator is illustrated in the aforecited Hauser application U.S. Ser. No. 606,954.

Serving to reset the counter control flip-flop 62 and thus the counter 22 is a start of message signal G fed via line 92. The start of message signal G may be provided from the transmitter via a separate line or generated in response to the decoding of a selected data word in the incoming data stream. The start of message signal G is fed through a dual input AND-gate 94 to a reset input 96 of the counter control flip-flop 62. The remaining input of the AND-gate 94 is fed by the output of the count "1248" decoder 82 resetting the flip-flop 62 at the end of the paper discharge operation. In this way the counter 22 is inhibited during printing, enabled during paper discharge and reinhibited upon completion of the paper discharge operation.

Operation

Figure 2:
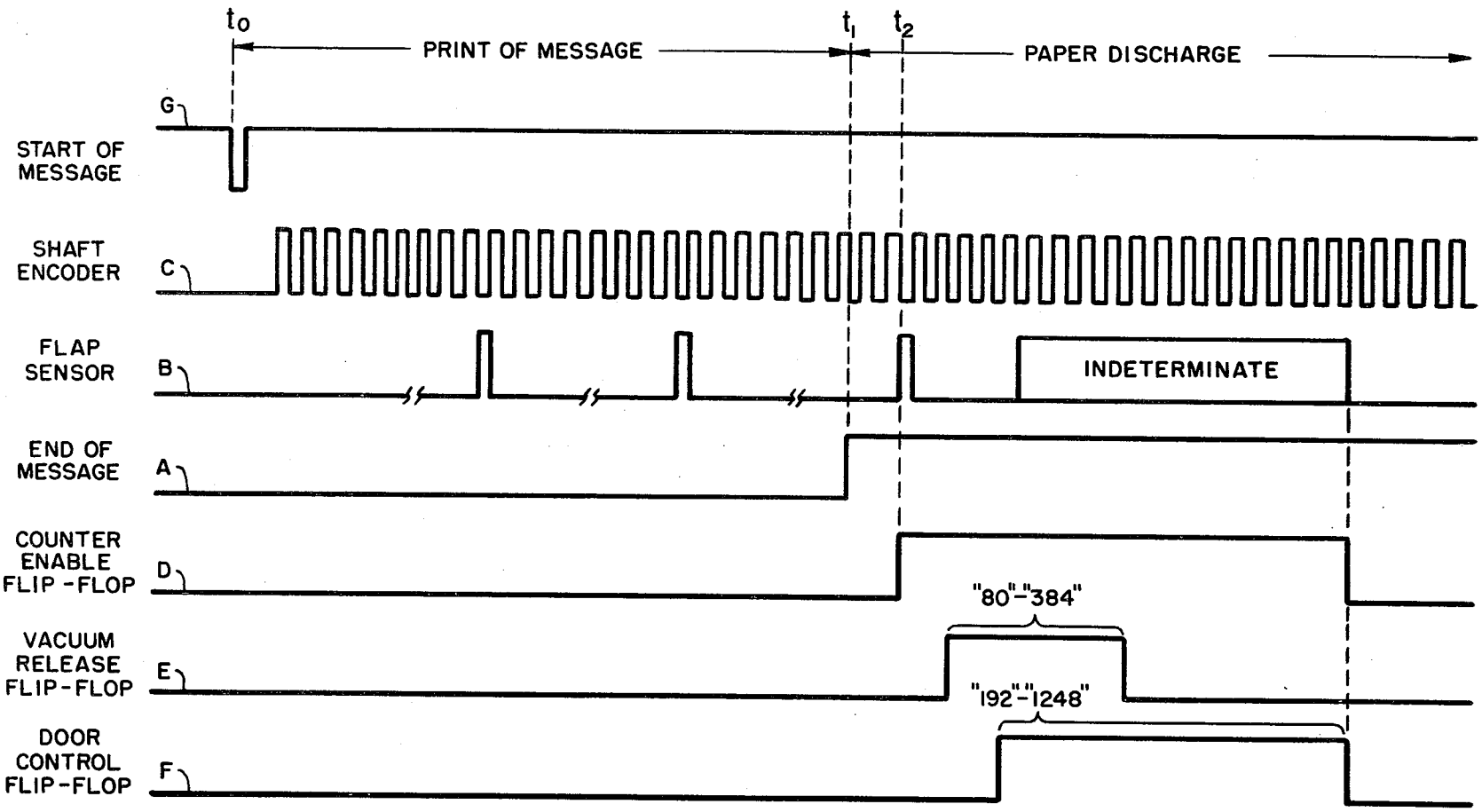
FIG. 2 is a timing diagram of the circuit of FIG. 1 during the discharge mode of operation.

With particular reference to the timing diagram illustrated in FIG. 2, at time $t_0$ the start of message pulse G initiates rotation of the drum 10 (by control means, not shown) and the output of the shaft encoder 24 provides a stream of pulses C. It is assumed that the paper 14 has been introduced to the drum 10 and is rotating therewith. The flap sensor 20 provides the single output pulse B for each sensing of the flap 40 passage. Should the reader desire further information concerning the introducing of the paper to the drum and the writing thereon, his attention is directed to a copending U.S. patent application by the inventor of this application filed simultaneously herewith and entitled "Method and Apparatus for Controlling a Web Handling Device" U.S. Ser. No. 662,781, now U.S. Pat. No. 4,047,085.

The start of message signal G also serves to reset the counter control flip-flop 62 through gate 94. At time $t_1$ an end of message signal A is received which is fed to the input of the NAND-gate 72. In response to the following flap sensor 20 pulse at time $t_2$, the flip-flop 62 output 64 goes high, and signal D enables the counter 22 which advances in response to the pulse train C generated by the shaft encoder 24. As illustrated, at count "80" signal level E from the flip-flop 76 actuates the vacuum release solenoid 12 releasing the vacuum within the drum 10 allowing the paper 14 to come to rest against the inside wall 34 of the shroud 28. It will be appreciated that once released, the paper 14 will randomly rest on the shroud 28 at a location determined by its weight and stiffness. The total time period during which the vacuum is released is selected to assure that the heaviest paper to be used will come to rest upon the inner wall of the shroud 28 before the vacuum within the drum 10 is reapplied. Since the location of the paper flap 40 during this interval is random, the output 13 of the flap sensor illustrated in FIG. 2 is indicated as being indeterminate during this period.

While the paper 14 is coming to rest within the shroud 28 at count "192" of the counter 22, the output level F of flip-flop 86, energizes the door solenoid 50 opening the door. Thus, by the time the vacuum is reapplied to the drum 10, corresponding to counter 22 state "384", the paper 14 and the discharge door 32 will be open. Thereafter, the vacuum is reapplied to the drum 10 and as the drum rotates, drawing the paper 14 with it, the paper 14 is forced around the shroud until the leading edge reaches the exit door 32 whereat it is thrown out along the discharge guide 60. It will be appreciated that several drum 10 revolutions are required for the paper to completely adhere to the drum thus assuring discharge before readherence of the paper 14 to the drum 10. At counter 22 state "1284" sufficient time has been allowed for papers of various grades and initial rest locations about the shroud 28 to be fully discharged. The door solenoid flip-flop 86 is reset. The decoder 82 output at counter states "1248" is also used to clear the counter control flip-flop 62 through the AND-gate 94. It has been found in practice that the operation of releasing the paper 14 from the drum 10 and then reapplying the vacuum while the drum 10 is rotating assures that the paper 14 will leave the shroud 28 regardless of its weight or stiffness.

Although the invention has been particularly shown and described with reference to a preferred embodiment thereof, it will be understood that various changes in form and detail may be made without departing from the spirit and scope of the invention.

What is claimed is:

1. An apparatus for discharging a sheet of paper from a rotating apertured drum platen, the apparatus including means for maintaining a vacuum within the drum so that the paper is maintained on the drum by vacuum pressure and a guide shroud disposed about the drum, the improvement comprising:

means for defining a paper discharge opening in the shroud, means for interrupting said vacuum means so as to interrupt the vacuum within the drum thereby allowing the paper to come to rest within the shroud;

means for reapplying the vacuum to the rotating drum whereby the rotating drum boosts the paper from the shroud through the discharge opening; and said drum being coupled to a shaft encoder generating a pulse train related to the rotation of the drum and wherein said vacuum interrupting means includes a counter driven by said pulse train and means for decoding at least one first selected state of said counter, said selected counter state determining when said interrupting means interrupts the vacuum pressure within the drum.

2. The apparatus of claim 1 which further includes a selectively operable door covering said discharge opening and wherein said selectively operable door is responsive to at least one second selected state of said counter, said door being opened during the reapplication of vacuum within said drum.

3. The apparatus of claim 2 wherein said vacuum is released for a first preselected number of sequential counter states and said door is open for a second preselected number of sequential counter states and wherein at least one of said first vacuum release counter states corresponds to at least one of said second door counter states.

4. The apparatus of claim 3 which further includes means for generating a signal in response to a preselected position of the paper with respect to the shroud and counter control means responsive to said paper position signal for starting said counter so that the states of said counter are related to the rotational position of the paper upon the drum.

5. A method for removing a sheet of paper maintained on a rotating drum by a vacuum pressure created within the drum, the drum being substantially surrounded by a shroud defining a discharge opening comprising the steps of:

releasing the vacuum created within the drum to allow the paper to come to rest within the shroud; and reapplying the vacuum to the rotating drum whereby the rotating drum boosts the paper out of the shroud through the discharge opening.

6. The method of claim 5 which further includes the step of opening a door covering the discharge opening in the shroud prior to the step of reapplication of the vacuum within the drum to allow the paper to pass therethrough.

* * * * *